US008091619B2

(12) United States Patent
Persson

(10) Patent No.: US 8,091,619 B2
(45) Date of Patent: Jan. 10, 2012

(54) HEAT EXCHANGER WITH INDENTATION PATTERN

(75) Inventor: Lars Persson, Abbekås (SE)

(73) Assignee: EP Technology AB, Malmõ (SE)

( * ) Notice: Subject to any disclaimer, the term of this patent is extended or adjusted under 35 U.S.C. 154(b) by 0 days.

(21) Appl. No.: 11/662,218

(22) PCT Filed: Sep. 7, 2005

(86) PCT No.: PCT/IB2005/053736

§ 371 (c)(1),
(2), (4) Date: Mar. 8, 2007

(87) PCT Pub. No.: WO2006/027761

PCT Pub. Date: Mar. 16, 2006

(65) Prior Publication Data

US 2007/0261829 A1 Nov. 15, 2007

(30) Foreign Application Priority Data

Sep. 8, 2004 (SE) ..... 0402152

(51) Int. Cl.
*F28F 3/04* (2006.01)

(52) U.S. Cl. ..... 165/166; 165/165

(58) Field of Classification Search ..... 165/165, 165/166, 167

See application file for complete search history.

(56) References Cited

U.S. PATENT DOCUMENTS 785,580 A * 3/1905 Shiels et al. ..... 165/165
2,236,976 A 4/1941 Fredrik
2,281,754 A * 5/1942 Dalzell ..... 165/167
2,959,400 A * 11/1960 Simpelaar ..... 165/166
3,024,003 A 3/1962 Speca et al.
3,106,242 A 10/1963 Jenssen et al.
3,227,598 A 1/1966 Robb
3,255,816 A * 6/1966 Rosenblad ..... 165/166
3,757,855 A 9/1973 Kun et al.
3,852,166 A * 12/1974 Palmason ..... 165/166
4,005,746 A 2/1977 Young
4,043,388 A * 8/1977 Zebuhr ..... 165/166
4,183,403 A 1/1980 Nicholson (Continued)

FOREIGN PATENT DOCUMENTS

DE 4308858 A1 9/1994

(Continued)

OTHER PUBLICATIONS

"International Search Report for Application No. PCT/IB2005/053736", 3 Pages.

(Continued)

*Primary Examiner* — Teresa Walberg
(74) *Attorney, Agent, or Firm* — Schwegman, Lundberg & Woessner, P.A

(57) ABSTRACT

The invention relates to a heat exchanger with an indentation pattern, and specifically a heat exchanger with heat exchanger plates (1) provided with a special pattern instead of the traditional herringbone pattern. The pattern comprises at least one section with bulges (2) and hollows (3), said bulges and hollows having flat tops and bottoms intended to be placed against respective hollows and bulges of a heat exchanger plate of a corresponding design. The surface area of said tops and bottoms is such in relation to the distance between the tops and bottoms that channels (6) for the flow of a medium are formed between the bulges.

15 Claims, 1 Drawing Sheet

U.S. PATENT DOCUMENTS

| | | | |
|---|---|---|---|
| 4,291,759 | A | 9/1981 | Sumitomo |
| 4,470,455 | A | 9/1984 | Sacca |
| 6,047,769 | A | 4/2000 | Shimoya et al. |
| 6,221,463 | B1 | 4/2001 | White |
| 6,340,052 | B1 | 1/2002 | Uehara |
| 2004/0011515 | A1 | 1/2004 | Matsushima |

FOREIGN PATENT DOCUMENTS

| | | | |
|---|---|---|---|
| EP | 0901914 | A1 | 3/1999 |
| EP | 0935115 | A2 | 8/1999 |
| EP | 0933608 | B1 | 4/2003 |
| GB | 901914 | | 7/1962 |
| JP | 38-12040 | | 2/1960 |
| JP | 11-287580 | A | 10/1999 |
| JP | 200205783 | A | 7/2000 |
| JP | 2004-11936 | A | 1/2004 |
| SE | 203139 | | 3/1966 |
| WO | WO-9735344 | A1 | 9/1997 |

OTHER PUBLICATIONS

"European Patent Application Serial No. 05801779.9, Communication mailed Jul. 8, 2008", 6 pgs.

"Japanese Application Serial No. 2007-529411, Notice of Grounds for Rejection mailed Nov. 26, 2010", (w/ English Translation), 6 pgs.

* cited by examiner

HEAT EXCHANGER WITH INDENTATION PATTERN

RELATED APPLICATIONS

This application is a nationalization under 35 U.S.C. 371 of PCT/IB2005/053736, filed Sep. 7, 2005 and published as WO 2006/027761 A2, on Mar. 16, 2006, which claimed priority under 35 U.S.C. 119 to Sweden Application No. 0402152-3, filed Sep. 8, 2004; which applications and publication are incorporated herein by reference and made a part hereof.

FIELD OF THE INVENTION

The present invention relates to a heat exchanger with an indentation pattern, and in particular a heat exchanger plate provided with a special pattern comprising bulges and hollows instead of the traditional herringbone pattern. As a result of the novel pattern, a stronger design and more favourable heat transfer characteristics are obtained.

STATE OF THE ART

Modern heat exchangers are often provided with plates having a so-called herringbone pattern, i.e. a pattern which has indentations consisting of straight ridges and valleys. The ridges and valleys change direction in the centre, producing the pattern that resembles a herringbone. In a heat exchanger pack, alternate plates are turned so that the indentations cross one another. Heat exchangers can be fully brazed or provided with rubber gaskets.

When a heat exchanger pack of this type is exposed to pressure and heat, the plates distort, causing a bending moment in the plates. In order to withstand high pressure, therefore, relatively thick sheet metal is used, e.g. with a thickness of 0.4 mm.

When plates are pressed into the herringbone pattern, an unfavourable material flow takes place. If the press tool is not very accurately manufactured, cracks can appear in the plates. The relatively thick plates also require a high pressure in the press tool.

In a fully brazed heat exchanger, the joints are brazed with copper solder placed between the plates. The solder material collects at the crossing points of the indentations. The surface area and strength of the solderings are therefore quite small.

A medium which is made to flow through a heat exchanger with a herringbone pattern is forced to flow over the ridges and down into the valleys. There are no unbroken straight flow-lines. At the leading edge of the ridges the flow rate is high, whereas the flow rate of the medium is low behind the ridges, in the valleys. This variation in flow rate is very large. In the heat exchanger the heat transfer rate is high where the flow rate is high, but the heat transfer rate is low where the flow rate is low. A smaller variation in flow rate than is the case in heat exchangers with a herringbone pattern would have been more favourable.

When the flowing medium contains of two phases, i.e. a mixture of a gas and a liquid, the recurring changes of direction at the ridges and valleys cause the gas to force the liquid away from contact with the plates. This reduction in wetting also reduces the rate of heat transfer.

The shape of the channels through the heat exchanger also gives rise to a high pressure drop in the medium as it passes through the heat exchanger. This pressure drop is proportional to the work done in forcing the medium through the heat exchanger. A high pressure drop thus means high power consumption.

SUMMARY OF THE INVENTION

The present invention solves the above problems, among others, by providing a pattern on a heat exchanger plate comprising indentations in the form of bulges and hollows, between which channels are formed through the heat exchanger. The shape of the channels gives rise to a moderate variation in flow rate through the heat exchanger, and thereby a better the heat transfer.

The invention provides a heat exchanger comprising heat exchanger plates having a pattern comprising at least one section with bulges and hollows, said bulges and hollows having flat tops and bottoms intended to be placed against respective hollows and bulges of a heat exchanger plate of corresponding design, the surface area of the tops and bottoms having a size in relation to the distance between said tops and bottoms such that channels for flow of a medium are formed between the bulges. The heat exchanger plates are firmly joined between bulges and hollows.

The invention is defined in claim 1 while preferred embodiments are set forth in the dependent claims.

BRIEF DESCRIPTION OF THE DRAWINGS

The invention will be described in detail below, with reference to the attached drawings, of which.

DETAILED DESCRIPTION OF PREFERRED EMBODIMENTS

Plate heat exchangers are generally known devices for transfer of heat between two different media Plate heat exchangers are used in many different contexts, and the current invention is not restricted to any special application. The invention is intended to be applied to fully brazed heat exchangers or heat exchangers assembled by other methods, such as by welding, adhesives, or diffusion. The heat exchanger comprises plates with a pattern of indentations and connections for inlet and outlet of two media. The plates are collected in a pack and joined together to form an integral unit. The joining of the plates creates separate channels for the two media, which circulate in counterflow between alternate pairs of plates. This technology is generally known and will therefore not be described in detail here.

Figure 1:
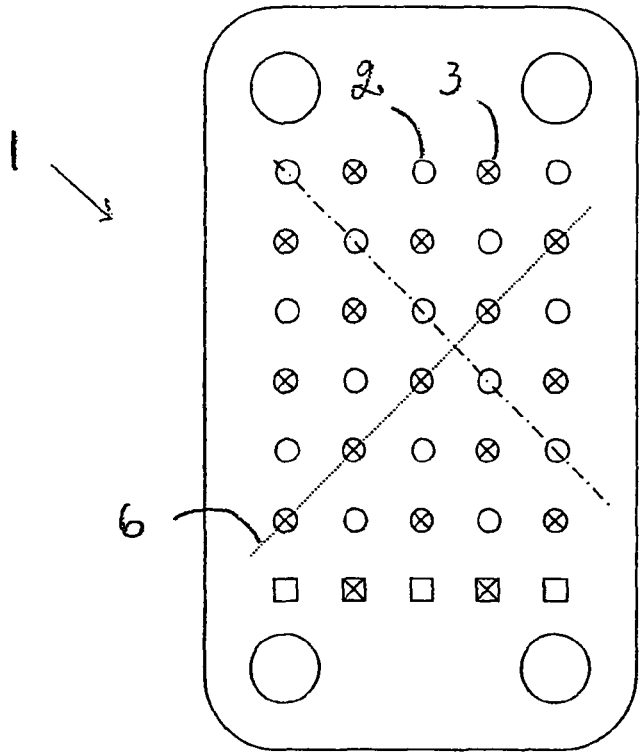
FIG. 1 is a plan view of a heat exchanger plate according to the invention.

FIG. 1 is a plan view of an example of a heat exchanger plate 1 according to the invention. In the four corners are the conventional connections for the inlet and outlet of two different media. Instead of the traditional herringbone pattern, the plate has a pattern of bulges 2 and hollows 3.

Figure 2:
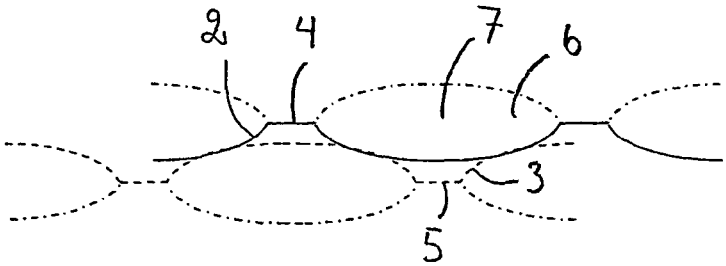
FIG. 2 is a cross section through of a number of such plates.

As is also apparent from FIG. 2, the bulges 2 are raised by a given height while the hollows 3 are sunk to a given depth in a plate. The bulges and hollows have flat tops 4 and bottoms 5. In FIG. 1, the bulges 2 are symbolised by circles, while the hollows 3 are symbolised by circles with a cross. In FIG. 1, the bulges and hollows are shown considerably larger than they would be in an actual heat exchanger. As with previous technology, the plate is manufactured by pressing in a tool. In contrast to the herringbone pattern, the pattern according to the invention is well suited to the pressing process.

The press tool consists of tool halves with upward and downward facing studs. The studs have a flat upper surface and flanks with an inclination of approximately 45°. At the start of pressing, the plate material is locked against the studs and follows their form so that the flanks of the bulges and hollows also have an edge angle of approx 45°. When a given press height has been reached, the plate material is released from the studs. In the section between the top 4 of a bulge 2 and the bottom 5 of a hollow 3 the material is permitted to flow freely to a certain extent. This combination of locking and releasing considerably reduces the risk of cracks appearing in the plates.

A heat exchanger is preferably manufactured by brazing together such plates. As shown in FIG. 2, an upper plate, indicated by a dotted line, is turned so that its downward-pointing hollows (bottoms)-abut against the upward-pointing tops 4 of a lower plate, indicated by a solid line. The upper and lower plates are brazed together as indicated by the number 4. Strong solderings are formed here, because of the large surface area of the tops and bottoms. The lower plate also has hollows 5. The hollow 5 does not lie in the same sectional plane as the top 4 and is therefore indicated by a dotted line. The hollow 5 is firmly brazed to a corresponding top of a lower plate.

In operation, the heat exchanger is filled with a pressurised medium which tends to force the plates apart. The plates can also expand due to increased temperature. Because of the pattern of bulges and hollows, all stresses generated in the plate material are in the direction of the material, and no or small bending moments are created. The absence of bending moments increases the strength of the structure. The strength of the heat exchanger is also increased by the improved solderings. Because of this improved strength, thinner sheet metal can be used for the heat exchanger plates. Alternatively, the usual plate thickness of 0.4 mm can be used, giving the heat exchanger a bursting pressure of 600 bar compared with 200 bar for a heat exchanger with a herringbone pattern and the same plate thickness.

Figure 3:
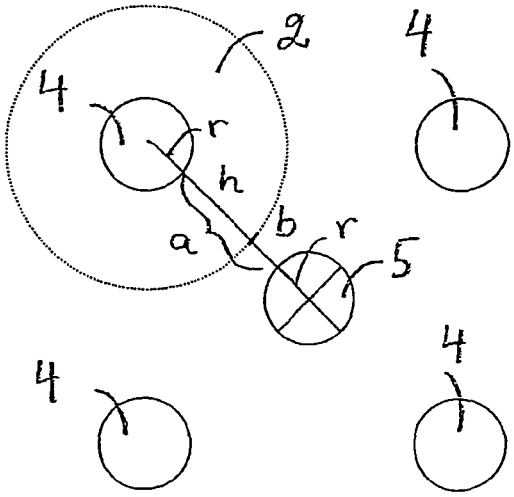
FIG. 3 is a plan view of an area of the plate having four bulges and one hollow.

To optimise strength, the radius of the top 4 of a bulge 2 can be optimised in relation to the distance between a bulge 2 and a hollow 3. FIG. 3 illustrates the variables used in the calculation.

r=radius of top of a bulge (=bottom of a hollow)

h=flank height of an indentation b=auxiliary variable (manufacture-related dimension)

a=h+b, i.e. distance from the edge of a top to that of a bottom

σ=yield strength or rupture limit of the material k=correction for forces not being at right angles to the plate The flank height of an indentation h is the radial distance from the area where the top begins to rise from plate height=0 to the edge of the top. Within a surface area delimited by four tops 4, the pressurised area is $2\,(2r+a)^2-\pi r^2$.

At the same time, the resisting force in the plate is=$2r\pi d\sigma k$.

$$\text{Pressure} = \frac{\text{resisting force}}{\text{pressure area}}$$

We look for the maximum pressure as r varies, i.e.

$$\frac{dp}{dr} = 0.$$

Hence, $$r = a\sqrt{\frac{2}{8-\pi}} \approx 0{,}64a$$

It is therefore preferable that the radius r of the tops and bottoms is approximately 0.64 a, where a is the distance from the edge of a top to that of a bottom. An excellent strength is also obtained when r is in the range (0.5-1)·a. In one embodiment, a=1.5 mm, with h=1.3 mm and b=0.2 mm. The height of the indentation is roughly equal to h with a flank angle of 45°. If r is too large, the number of solder points is too small, while if r is too small, the solder points are too weak.

FIG. 2 shows a section through several plates along the dash-dotted line in FIG. 1. It is apparent that channels 6 are formed through the heat exchanger. Over the plate indicated by the solid line, channels 6 are formed between the tops 4. The channels 6 also pass over and under hollows such as at 5. Only the lower hollows are shown. Under the plate indicated by the solid line, channels are formed between hollows 5, similarly passing tops 4.

FIGS. 1 and 2 show bulges 2 and hollows 3 placed symmetrically in a rectangular grid, with bulges and hollows on every other site. Thus, they are located one after the other along a number of parallel lines, the distance between bulges 2 and hollows 3 being equal and the distance between lines being equal. The channels will then be straight, running at 45° to the edge of the heat exchanger with a clear passage straight through the heat exchanger. Such a channel is indicated by a dotted line 6 in FIG. 1. In other words, the medium is not forced to flow over ridges and valleys as in the herringbone pattern, but encounters only the rounded constrictions at the solder points where tops meet and the expansions where hollows lie opposite one another. However, the bulges and hollows still cause a certain amount of variation in flow rate and some turbulence in the medium. It is known that it is not desirable to eliminate turbulence completely, because laminar flow gives poorer heat transfer. With the pattern according to the invention moderate turbulence is obtained with moderate flow rate variation in the medium. Thus a lower pressure drop across the heat exchanger is obtained for a given average flow rate of the medium. The power required to force a medium through the heat exchanger is also lower.

Compared to a heat exchanger with a herringbone pattern, the above invention can provide better heat transfer with the same input power (pressure drop). Alternatively, the same heat transfer can be obtained with a lower input power.

As shown in FIG. 2, the channels 6, especially at the centre, have a gap 7 with free flow. Here, the medium does not need to change direction because of nearness to the tops 4, but is affected only to some extent by the hollows 5. If a heat exchanger with channels of this type is used with a two-phased medium, i.e. one containing both gas and liquid, the gas phase tends to flow along said gap 7 in the centre of the channel 6. This means that the gas flows through the heat exchanger without compromising the wetting of the heat exchanger plates by the liquid phase. This provides better heat transfer.

In some operational cases, nuclear boiling can also occur instead of surface evaporation, especially in the hollows, where the flow rate is lowest. The hollows facilitate spontaneous boiling. This further improves heat transfer.

Although the circular shape of the indentations is advantageous, this is not absolutely necessary. Other forms, such as ovals and polygonal shapes, are possible, e.g. squares with sides facing each other. An example of square tops is shown at 9 in FIG. 1.

In an alternative embodiment, the bulges and hollows are located symmetrically in a grid, but unlike the embodiment shown in FIG. 1, the grid is arranged so that the channels formed are parallel with the edges of the heat exchanger (not shown). This arrangement results in a lower pressure drop but also a lower heat transfer rate, because the tops obscure one another. In this way, different arrangements can be used to direct the flow of media in the desired way and to control turbulence and pressure drop.

Nor does the pattern need to be symmetrical over the whole plate, although a symmetrical pattern provides maximum strength.

It is not necessary that the pattern according to the invention covers the whole of the heat exchanger plate 1. The pattern can be combined with deflecting barriers and baffles, with completely flat surfaces, and also with conventional herringbone patterns if this is required for reasons not directly related to the present invention. Further variants will also be apparent to one skilled in the art. The scope of the invention is limited only by the attached claims.

The invention claimed is:

1. A fully brazed heat exchanger comprising a plurality of pairs of heat exchanger plates, each heat exchanger plate formed of pressed sheet metal disposed along a central plane with a pattern comprising at least one section with bulges extending from the central plane in a first direction normal to the central plane and hollows extending in a second direction from the central plane, the second direction being opposite the first direction, said bulges and hollows having flat tops and bottoms and each of the bulges and hollows including a substantially parabolic-shaped flank, wherein each pair of the heat exchanger plates is fully brazed together, with the flat tops of the bulges of one of the pair of heat exchanger plates abutting and firmly brazed to the corresponding flat bottoms of the hollows of the other of the pair of heat exchanger plates, the surface area of each of said tops and bottoms having a size in relation to the distance between said tops and bottoms such that channels for flow of a medium are formed between pairs of adjacent bulges, the channels including substantially flat areas at locations between adjacent bulges, the substantially flat areas being substantially parallel to the flat tops and bottoms of the bulges and hollows, wherein the substantially flat areas are not joined with an adjacent heat exchanger plate, wherein the flanks of the bulges and hollows have an edge angle of approximately 45°, and wherein each heat exchanger plate includes a saddle-shaped area of freely deformed pressed sheet metal between adjacent flat bottoms of the bulges and flat tops of the hollows, the flat tops and bottoms being circular, the surface areas of said tops and bottoms each having a radius that is optimized in size in relation to the distance between the tops and bottoms, whereby a strength of the heat exchanger is increased by means of the optimized radius, and the radius of each of the tops and the bottoms being within the range of 0.5×a to 1×a, wherein a is the distance from an edge of the top to an edge of the bottom.

2. A heat exchanger according to claim 1, wherein the plate thickness is equal or less than 0.4 mm.

3. A heat exchanger according to claim 1, wherein said channels comprise a gap permitting flow without change of direction.

4. A heat exchanger according to claim 1, wherein said bulges and hollows are located one after the other along a number of parallel lines, the distance between bulges and hollows being equal and the distance between lines being equal.

5. A heat exchanger according to claim 4, wherein said channels form an angle of approximately 45° with the edge of the plate.

6. A heat exchanger according to claim 1, wherein the radius r of the tops and the bottoms is approximately equal to 0.64×a.

7. A heat exchanger according to claim 1, wherein the bulges and hollows are located one after the other along a number of parallel lines, the distance between bulges and hollows being equal and the distance between lines being equal, the bulges and hollows being arranged symmetrically in a grid, which is arranged so that the channels formed are parallel with edges of the heat exchanger plate.

8. A heat exchanger according to claim 1, wherein the heat exchanger plates include a substantially cubic parabolic curve between adjacent bulges and hollows.

9. A fully brazed heat exchanger, comprising a plurality of heat exchanger plates fully brazed together, each heat exchanger plate formed of pressed sheet metal disposed along a central plane with a pattern comprising at least one section with bulges extending from the central plane in a first direction normal to the central plane and hollows extending in a second direction from the central plane, the second direction being opposite the first direction, said bulges and hollows including substantially parabolic-shaped flanks, the bulges and hollows having flat tops and flat bottoms configured to abut respective hollows and bulges of another heat exchanger plate, the flat tops and bottoms being circular, the tops and bottoms each having a surface area with an optimized radius sized in relation to a distance between said tops and bottoms such that channels for flow of a medium are formed between the bulges, the optimized radius being in the range of 0.5×a to 1.0×a, where a is the distance from edges of the tops to edges of the bottoms, the heat exchanger plates being firmly brazed at the corresponding tops and bottoms of the bulges and hollows, respectively, of adjacent heat exchanger plates, the surface area of each of the tops and bottoms resulting from the optimized radius sized and configured to provide an optimized strength of the fully brazed heat exchanger plates, and wherein the flanks of the bulges and hollows include an edge angle of approximately 45°, and wherein the shapes of the bulges and the hollows are configured to eliminate bending moments in the heat exchanger plates when pressurized.

10. A heat exchanger according to claim 9, wherein at least one of the heat exchanger plates comprising a plate thickness equal or less than 0.4 mm.

11. A heat exchanger according to claim 10, wherein said channels comprise a gap permitting flow without change of direction.

12. A heat exchanger according to claim 11, wherein said bulges and hollows are located one after the other along a number of parallel lines, the distance between bulges and hollows being equal and the distance between lines being equal.

13. A heat exchanger according to claim 9, wherein the radius r of the tops and the bottoms is approximately equal to 0.64×a.

14. A heat exchanger according to claim 9, wherein the bulges and hollows are located one after the other along a number of parallel lines, the distance between bulges and hollows being equal and the distance between lines being equal, the bulges and hollows being arranged symmetrically in a grid, which is arranged so that the channels formed are parallel with edges of the heat exchanger plate.

15. A heat exchanger according to claim 9, wherein the heat exchanger plates include a substantially cubic parabolic curve between adjacent bulges and hollows.

* * * * *